US006952168B2

(12) United States Patent
Recko, Jr. et al.

(10) Patent No.: US 6,952,168 B2
(45) Date of Patent: Oct. 4, 2005

(54) AUDIO CONE MODULE

(75) Inventors: Paul J. Recko, Jr., Stephens City, VA (US); Craig K. Rogers, Winchester, VA (US); Shannon C. Dulaney, Berryville, VA (US); Robert W. Lauer, Winchester, VA (US)

(73) Assignee: Rubbermaid Commercial Products LLC, Winchester, VA (US)

( * ) Notice: Subject to any disclaimer, the term of this patent is extended or adjusted under 35 U.S.C. 154(b) by 226 days.

(21) Appl. No.: 10/011,746

(22) Filed: Dec. 11, 2001

(65) Prior Publication Data

US 2003/0107493 A1 Jun. 12, 2003

(51) Int. Cl.[7] ..... G08B 23/00

(52) U.S. Cl. ..... 340/573.4; 340/331; 340/565; 340/692; 340/693.5; 340/693.9

(58) Field of Search ..... 340/573.4, 573.1, 340/693.5, 693.9, 691.1, 692, 540, 331, 332, 565–567, 552–557; 367/93–94

(56) References Cited

U.S. PATENT DOCUMENTS

| | | | | | |
|---|---|---|---|---|---|
| 2,948,257 | A | | 9/1960 | Levey | 116/63 R |
| 3,560,950 | A | | 2/1971 | Peters | 340/555 |
| 3,771,123 | A | | 11/1973 | Lanes | 340/435 |
| 3,920,981 | A | | 11/1975 | Bailey | |
| D277,738 | S | | 2/1985 | Grammas et al. | D10/109 |
| D277,739 | S | | 2/1985 | Grammas et al. | D10/104 |
| 4,772,869 | A | | 9/1988 | Grammas et al. | 340/815.73 X |
| 4,794,368 | A | | 12/1988 | Grossheim et al. | |
| 4,912,457 | A | * | 3/1990 | Ladd | 340/573.1 |
| 4,951,045 | A | | 8/1990 | Knapp et al. | 340/944 |
| 4,954,813 | A | | 9/1990 | August, Sr. et al. | |
| 5,264,822 | A | * | 11/1993 | Vogelman et al. | 340/692 X |
| 5,265,556 | A | * | 11/1993 | Hall | 116/63 P |
| 5,315,285 | A | | 5/1994 | Nykerk | |
| 5,440,292 | A | | 8/1995 | Bedrosian | 340/567 |
| 5,463,595 | A | | 10/1995 | Rodhall et al. | 367/93 |
| 5,532,680 | A | * | 7/1996 | Ousborne | 340/567 |
| 5,577,824 | A | | 11/1996 | Wright | |
| 5,657,007 | A | | 8/1997 | Anderson et al. | 340/904 |
| D389,078 | S | | 1/1998 | Freeman et al. | D10/114 |
| 5,829,913 | A | | 11/1998 | Puckett | |
| 5,877,698 | A | * | 3/1999 | Kusnier | 340/692 X |
| 5,886,631 | A | * | 3/1999 | Ralph | 340/541 |
| D411,810 | S | | 7/1999 | Stockman | D10/113 |
| 6,003,257 | A | | 12/1999 | Stokes | |
| D419,901 | S | | 2/2000 | Alt | D10/113 |
| 6,075,450 | A | | 6/2000 | Clark | 340/691.1 |
| 6,087,938 | A | | 7/2000 | Gitelis et al. | 340/567 |
| 6,288,642 | B1 | | 9/2001 | Dohrmann | 340/540 |
| 6,288,651 | B1 | * | 9/2001 | Souza | 340/933 |
| 6,323,773 | B1 | | 11/2001 | Runyon et al. | 340/573.1 |
| 6,357,382 | B1 | * | 3/2002 | Clark | 116/137 R |
| 6,512,451 | B1 | * | 1/2003 | Eslambolchi et al. | 340/425.5 |
| 2003/0041494 | A1 | * | 3/2003 | Yucht | 40/617 |

FOREIGN PATENT DOCUMENTS

| | | |
|---|---|---|
| DE | 196 43 247 A1 | 4/1998 |
| GB | 2 215 104 A | 9/1989 |
| GB | 2344915 | 6/2000 |
| GB | 2 376 552 A | 12/2002 |
| JP | 2000090362 A | 3/2000 |
| WO | 90/04529 | 5/1990 |

* cited by examiner

*Primary Examiner*—Thomas Mullen
(74) *Attorney, Agent, or Firm*—Foley & Lardner LLP

(57) ABSTRACT

A safety device, comprising at least one sensor for sensing the presence of an object and a warning system that emits at least one precreated verbal warning message after the sensor senses an object. The warning system includes a control system that allows a user to select at least one of a plurality of precreated verbal warning messages for emission. In another embodiment, a safety device comprises a safety cone, a sensor disposed on the safety cone and that senses an object, and a warning system disposed at the top of the safety cone and that emits at least one warning signal after the sensor senses an object.

61 Claims, 10 Drawing Sheets

AUDIO CONE MODULE

BACKGROUND OF THE INVENTION

1. Field of the Invention

The present invention relates to a safety device and a method of providing a warning and, more particularly, to a safety device and method that sense the presence of an object and provide a warning after the object is sensed.

2. Description of Related Art

Warning devices often are used to warn pedestrians of conditions that may be dangerous, especially conditions that may not be readily apparent to pedestrians. A common example is the plastic safety cone or obelisk of yellow or orange color with wording stating that a floor is wet, often accompanied with a schematic showing a person slipping. Another example is a warning sign with wording stating that an area, such as a washroom, is being serviced and should not be used; or if used, should be used with caution.

Generally, such warning devices rely on line of sight visual contact with the device and are often overlooked or even ignored by hurried pedestrians. Safety cones, for example, tend to be low to the ground and outside the line of sight. Safety cones and signs can also be obstructed by other people or other fixtures inside or outside a traffic area. Indeed, the effectiveness of such devices relies on the pedestrian to actually look where he or she is going. Distractions such as the morning paper or an attention attracting object can completely negate the device's effectiveness.

Warning devices also come with more active warnings. For example, flashing lights are often attached to signs to attract attention. Another example is an audible warning repeated at intervals over an intercom system that pedestrians should avoid doing certain things.

A problem with these devices is that, like passive warning signs, people quickly grow accustomed to the repetitious warnings and they tend to subconsciously block out the warning. Furthermore, the constant repetition tends to diminish the life expectancy of the device and, for stand alone devices, to deplete the batteries powering the device rather quickly.

Conventional warning devices can also lack adaptability. Typically warning devices have a fixed message, i.e., the message cannot be changed to accommodate the use of the warning device. For example, a safety cone bearing a warning of a wet floor typically cannot be effectively used to warn of a hole created by a construction crew. A standing sign that warns that a washroom is being serviced, cannot be effectively used to warn that an escalator is under repair. In short, the warning device cannot be readily changed to warn of a different hazard.

A warning device that overcomes one or more of the above mentioned problems is desired.

SUMMARY OF THE INVENTION

It is to be understood that both the foregoing general description and the following detailed description are exemplary and explanatory only and are not restrictive of the invention, as claimed.

An aspect of the present invention relates to a safety device including at least one sensor for sensing the presence of an object, and a warning system that emits at least one precreated verbal warning message after the sensor senses an object. The warning system includes a control system that allows a user to select at least one of a plurality of precreated verbal warning messages for emission.

In a further aspect of the present invention, the safety device further comprises a support structure. The support structure can include, for example, a safety cone or a sign. In a further aspect of the present invention, the safety device can be configured to be attached to a permanent structure.

Yet another aspect of the present invention relates to a safety device including a safety cone, a sensor and a warning system. The sensor is disposed on the safety cone and senses an object. The warning system is disposed at the top of the safety cone and emits at least one warning signal after the sensor senses an object.

Another aspect of the present invention relates to a method of providing a warning. The method includes the steps of providing a safety device containing a plurality of precreated warning signals associated with a plurality of displacement areas, which safety device emits at least one of the precreated warning signals after an object is sensed, disposing the safety device in a displacement area, and selecting at least one of the precreated warning signals for emission based on the displacement area.

BRIEF DESCRIPTION OF THE DRAWINGS

The accompanying drawings, which are incorporated in and constitute a part of this specification, illustrate preferred embodiments of the invention and together with the description, serve to explain the principles of the invention.

DETAILED DESCRIPTION OF THE PREFERRED EMBODIMENTS

Reference will now be made in detail to the present preferred embodiments of the invention, examples of which are illustrated in the accompanying drawings. Wherever possible, the same reference numbers will be used throughout the drawings to refer to the same or like parts.

Figure 1:
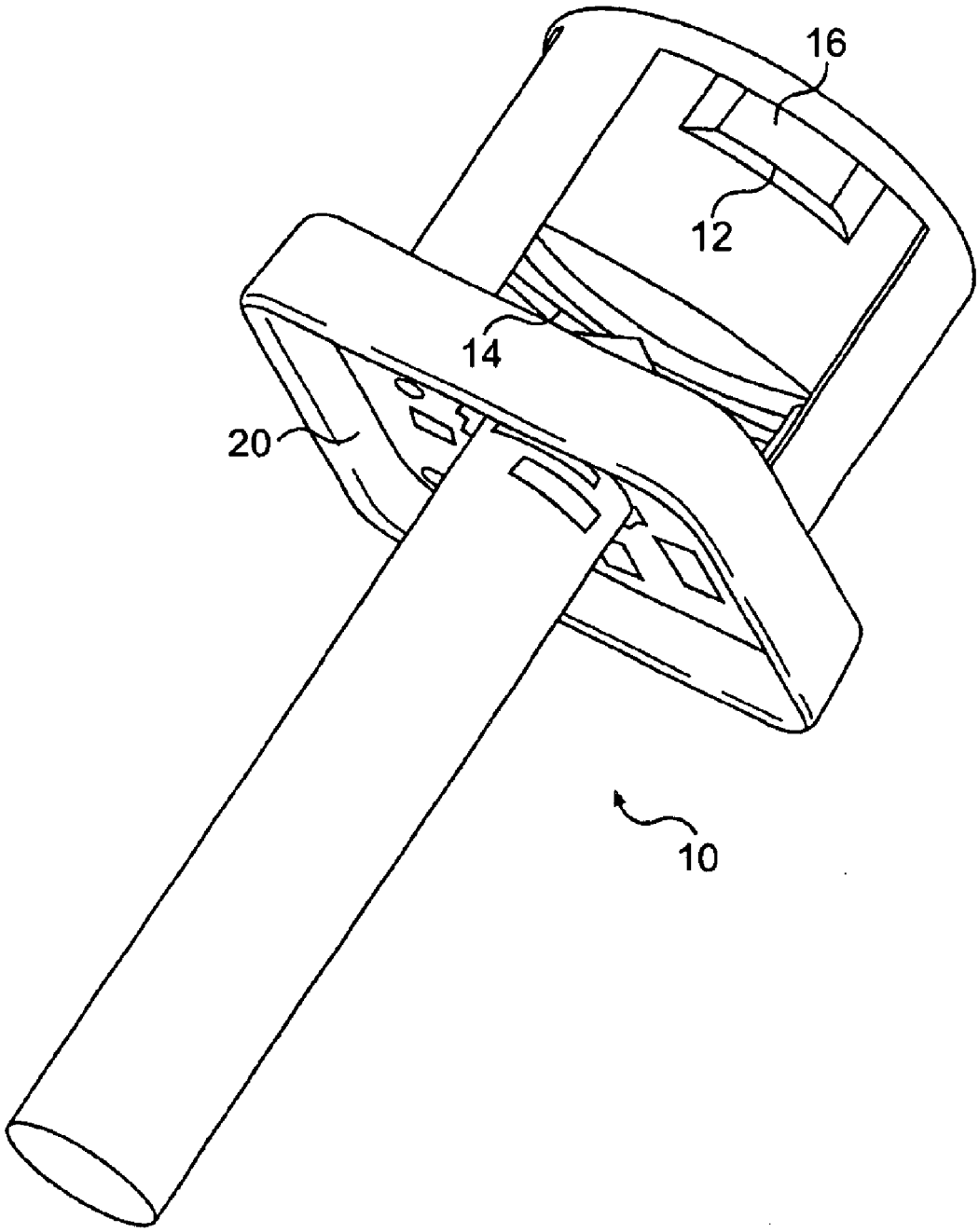
FIG. 1 is a perspective view of a first preferred embodiment of a safety device according to the present invention.

FIG. 1 shows a first embodiment of a safety device 10 according to the present invention. The safety device 10 includes at least one sensor 12 for sensing the presence of an object. The safety device 10 further includes a warning system 14 that emits a warning after the sensor 12 senses an object.

The object that will be sensed by the sensor 12 is preferably a person. It can, however, be other objects such as a pet, wheel chair, walker, scooter, stroller, etc. The sensor 12 can be selected to sense a detectable characteristic of the object, such as sound, vibrations, shock, light, heat, gas, infrared radiation, and ultrasonic noise. The sensor 12 could also detect combinations of detectable characteristics. Although the previously mentioned sensors are passive, active sensors can be used, such as sensors utilizing lasers and sensors utilizing sound waves.

In the first preferred embodiment shown in FIG. 1, the sensor 12 includes a sensing device 16. In the preferred embodiment, the sensing device utilized is an infrared detector. The detector is a PerkinElmer LHI 1128 passive infrared detector used in combination with a Fresnel Technologies EWA0.3GIVI passive infrared lens array.

Figure 7:
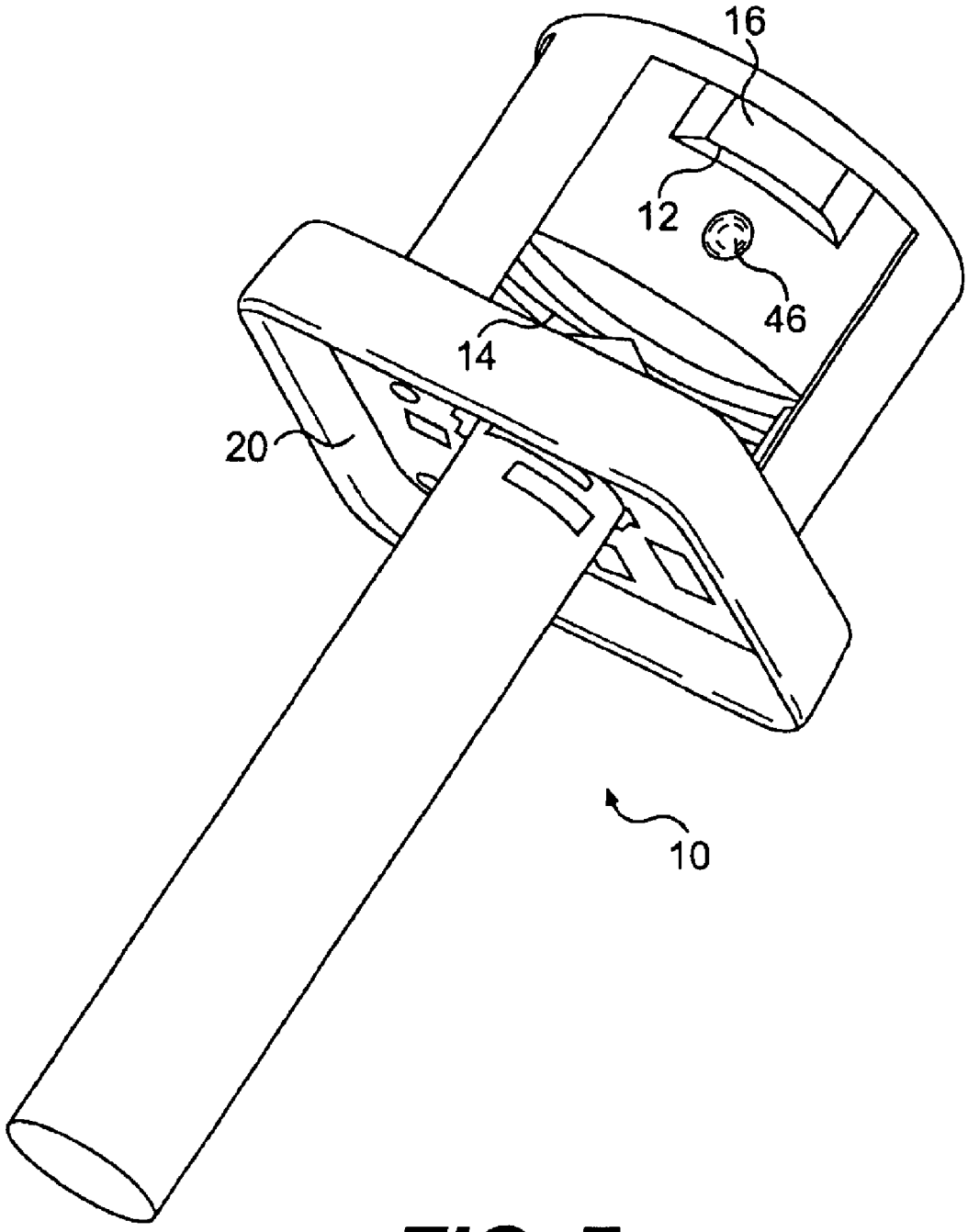
FIG. 7 is a perspective view of a second embodiment of a safety device, including a sensor having a plurality of sensing devices.

Although only one sensing device 16 is disclosed in FIG. 1, the invention can be practiced with two or more sensing devices. For example, FIG. 7 shows a second embodiment of the invention in which there is a sensing device 16 and a second sensing device 46. When using two or more sensing devices, the invention may be practiced by utilizing a sensing device of one type and a sensing device of another type. For example, the safety device could include both a sensing device that detects ultrasonic noise and a sensing device that detects movement. Additionally, a combination of both active sensing devices and passive sensing devices could be used.

Referring back to FIG. 1, the sensor 12 is preferably positioned on the safety device 10 at a position that facilitates the desired sensing. Preferably, the sensor 12 is positioned at a high point on the safety device 10, as this is conducive to modularization of the warning device. More preferably, the sensor 12 is disposed at or near the top of the safety device 10, because the sensor support structure tends to be robust and it provides shelter to the warning system 14. Additionally, there are maintenance reasons why it is preferred that the sensor 12 be disposed at or near the top of the safety device 10.

Figure 8:
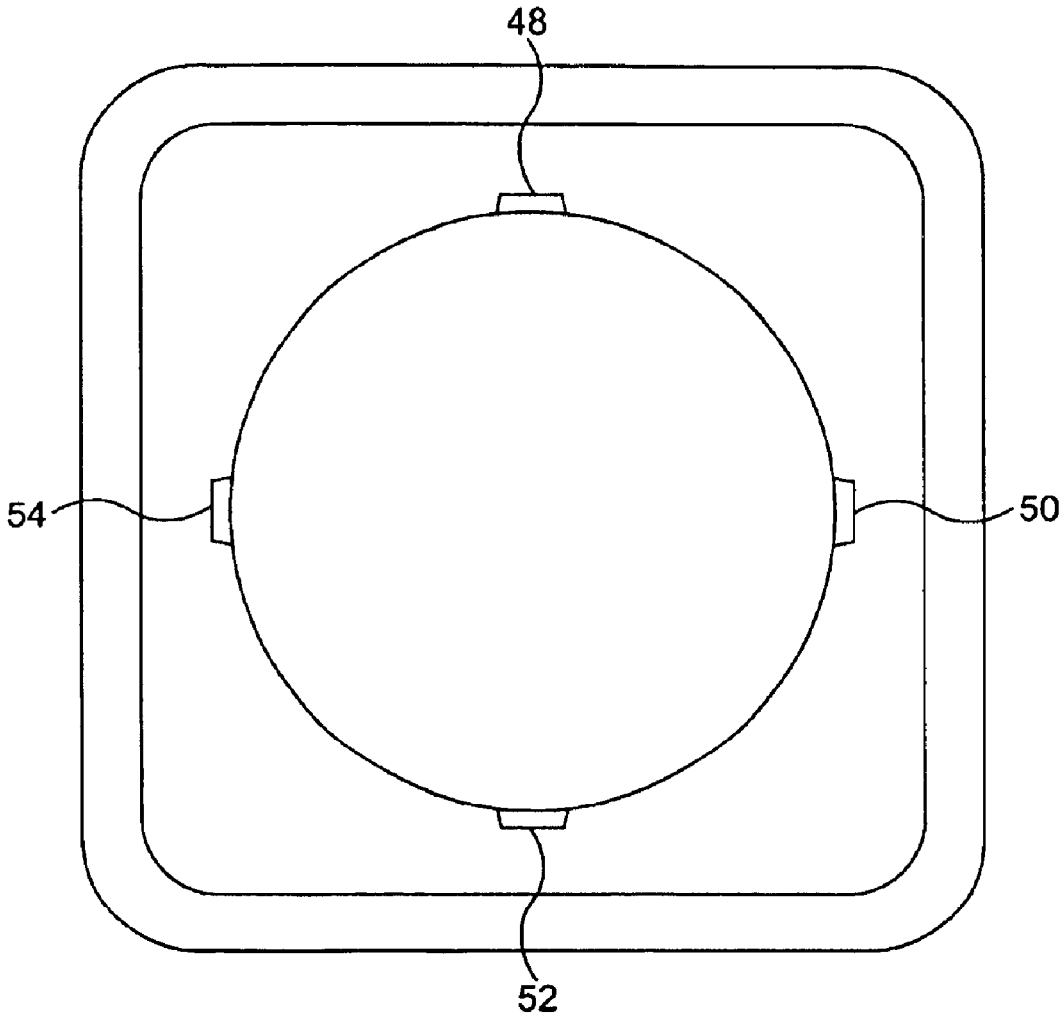
FIG. 8 is a top view of a third embodiment of a safety device, including a sensor having a plurality of equally spaced sensing devices.

When using two or more sensing devices, as can be seen from the second embodiment shown in FIG. 7, the sensing devices 16, 46 can be disposed at different heights on the safety device 10. Also, the sensing devices can be equally spaced laterally, as shown in the third embodiment of the invention illustrated in FIG. 8. In this third embodiment the sensing devices 48 through 54 are equally spaced, as this tends to maximize the space sensed by the sensors and also provide areas where an object can be sensed by more than one sensor. It should be noted that embodiments where the sensors are not equally spaced are also envisioned. For example, a safety device utilizing three sensing devices could have two or three sensing devices on one side of the safety device. This would be done, for example, in situations where the safety device utilizes sensing devices of different types or when sensing in a certain direction is more desirable than sensing in another direction. FIG. 7 shows such an example, where sensing device 16 and sensing device 46 are of different types. It is further envisioned that a sensing device can be positioned to sense objects above the safety device as well.

Figure 2:
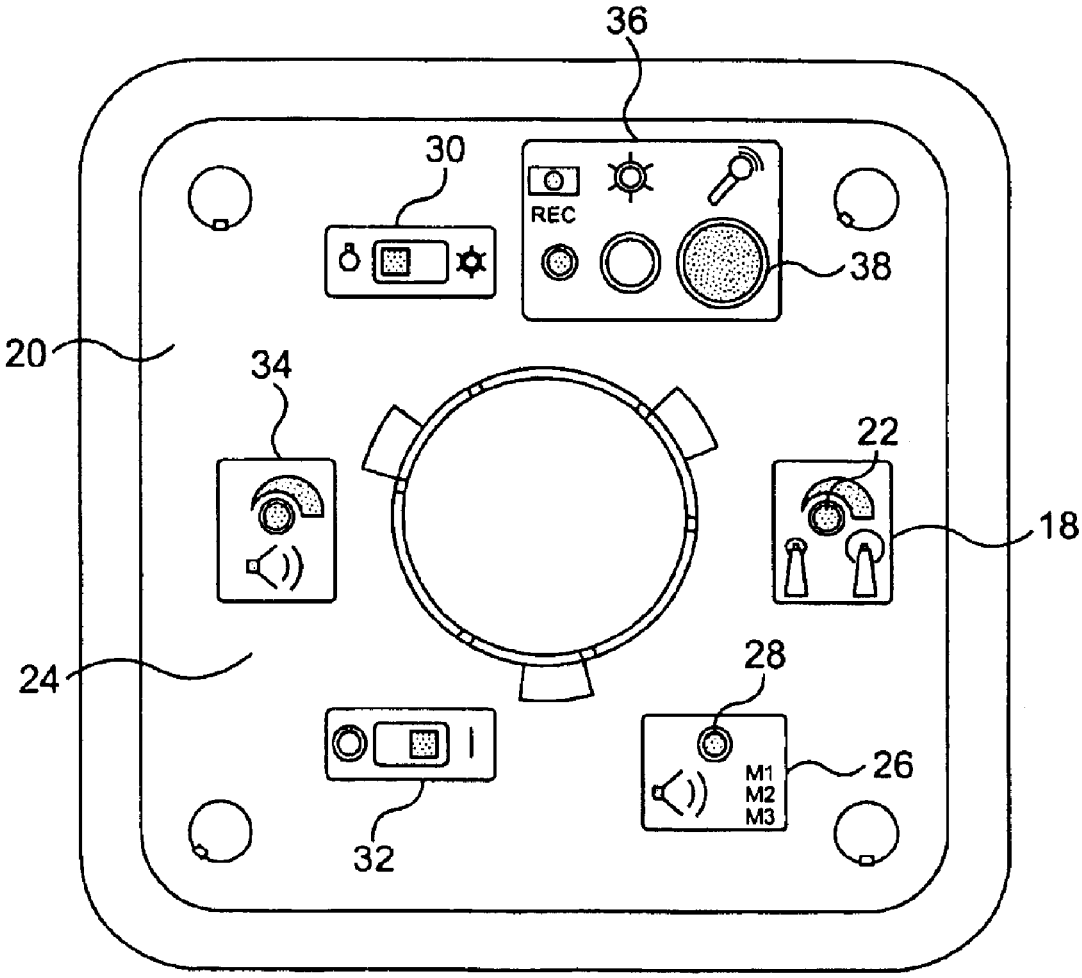
FIG. 2 is a bottom view of the safety device of FIG. 1.
Figure 3:
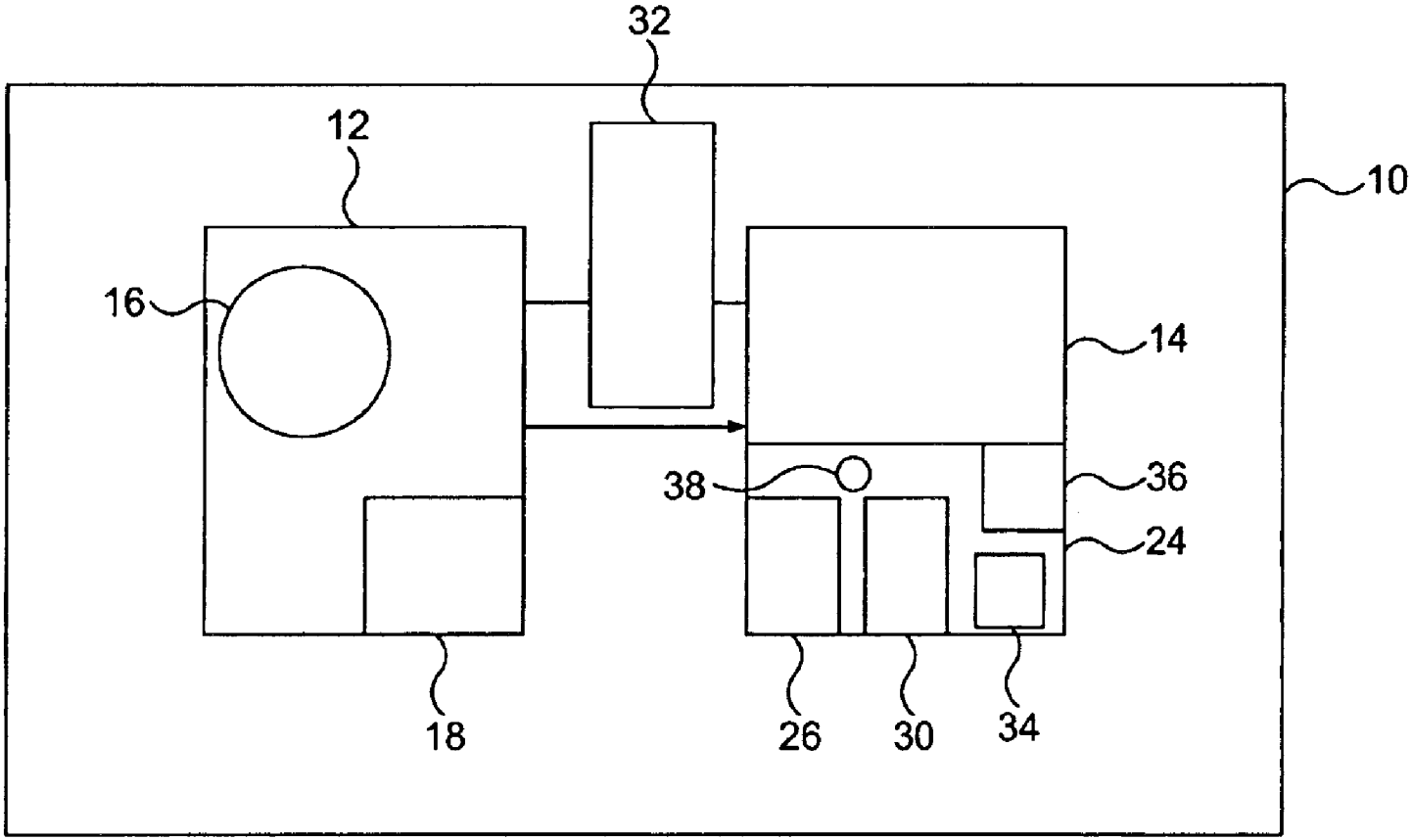
FIG. 3 is a schematic of the safety device of FIG. 1.

FIGS. 2 and 3 show a control mechanism 18 for the sensor 12, which permits the user to adjust the sensitivity of the sensor 12. It is envisioned that control mechanism 18 can be part of sensor 12, or can be a separate component. In this embodiment, a knob 22 for the control mechanism 18 is located on a control platform 20 of the safety device 10, although it is envisioned that the knob 22 can be placed in other locations. The control mechanism 18 allows the user to set the range of the sensor 12. For example, the control mechanism 18 can be used to set the sensor 12 to sense an object ten feet away, or set the sensor 12 to sense an object five feet away. Of course, other distances could be selected as the ranges of the sensor 12, and the control mechanism 18 could enable use of more than two distances. Additionally, the control mechanism 18 can be configured to provide a continuous range of sensing.

Figure 9:
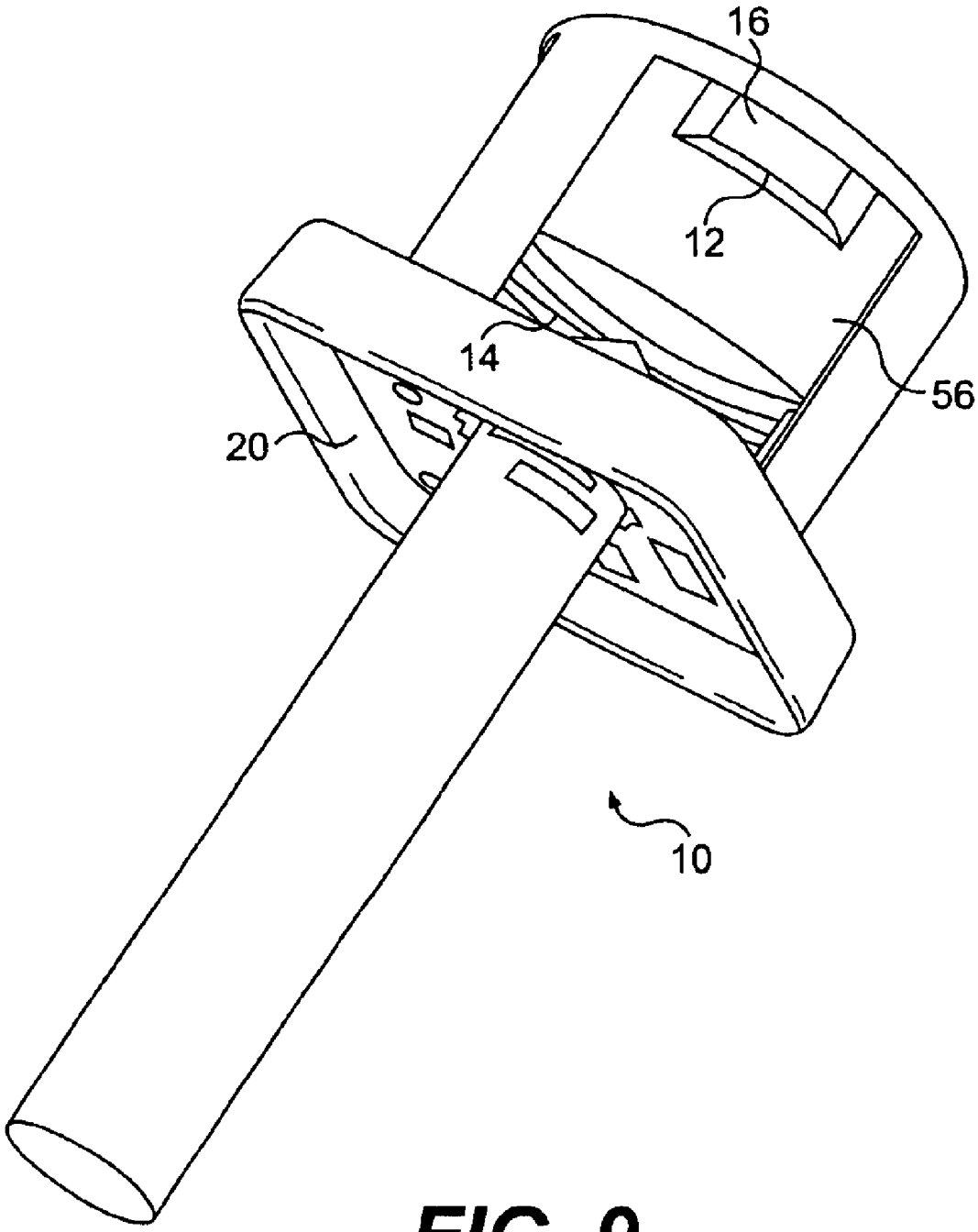
FIG. 9 is a perspective view of a fourth embodiment of a safety device, including a light.

The first embodiment of a safety device 10, as shown in FIGS. 1 and 3, further comprises a warning system 14 that emits at least one warning signal after the sensor 12 senses an object. Preferably, the warning signal is a precreated verbal warning message. For example, the verbal warning message could emulate a human voice saying the words "warning, wet floor." The warning signal could instead be a nonverbal audible signal, such as a beeping noise or a horn sound. As yet another alternative, the warning signal could be a visual warning. In this regard, FIG. 9 shows a fourth embodiment of the present invention, having a flashing light 56 that provides a visual warning signal. In the preferred embodiment, the flashing light 56 would include translucent or transparent material and a light positioned below the sensor 12. The present invention also can be practiced by combining certain or all of the above-mentioned signals. It is envisioned that the present invention can be practiced by fabricating a safety device comprising conventional circuitry and conventional input/output devices as would be apparent to one skilled in the art.

The warning system 14 preferably contains a plurality of warning messages. For example the warning messages could be a plurality of precreated verbal warning messages. The precreated verbal warning messages could provide warnings related to different hazards, such as wet floor, restroom in service, and floor under repair. Similarly, the warning messages could be a plurality of nonverbal audible signals, or a plurality of visual warnings. As yet another alternative, the warning signals could be combinations of any of precreated verbal warning messages, nonverbal audible signals, or visual warnings.

The warning system 14 preferably includes a control system 24, shown in FIG. 3. The control system 14 can include control mechanism 26 that allows a user to select at least one of the plurality of warning messages for emission. The control mechanism 26 preferably includes a push button switch 28 (see FIG. 2) which the user presses to change the message to be emitted. The user simply presses the button repeatedly until he or she arrives at the desired message. Alternatively, it is envisioned that a control switch will be used allowing the user to simply hold down the button until he or she arrives at the desired message. The control mechanism 26 also could be a rotating switch or a toggle switch. It is further envisioned that multiple switches can be used, depending on the complexity of the device. Indeed, it is envisioned that any appropriate mechanism that will allow the user to alternate the warning message can be used.

This control system 24 permits the user to set or program the warning system 14 to emit the desired warning after the sensor 12 senses an object. An advantage of this control system 24 is that it allows the user to select a warning message appropriate for the intended deployment of the safety device 10. Preferably the safety device 10 includes a device, such as a switch 30, that provides the user with the ability to activate and deactivate the visual signal. Switch 30 can be part of control system 24, or can be separate from control system 24. The preferred embodiment of the present invention also includes a device, such as a switch 32, that provides the user with the ability to activate and deactivate the entire device. It is envisioned that the present invention can be practiced with only a switch for the visual signal or only a switch for the entire device, or neither. This provides the user with the ability to control the type of signal he or she desires to be emitted from the safety device.

The safety device 10 preferably includes a mechanism that adjusts the strength of the warning message. For example the mechanism could be a volume adjustment 34 that allows the user to adjust the volume of one or more of the audible signals. Volume adjustment 34 can be part of control system 24, or can be separate from control system 24. Further, it is envisioned that the volume adjustment 34 could provide the user with the ability to activate and deactivate the audible signals, by, for example, either simply reducing the volume below an audible level, or by shutting off the system completely. However, it is envisioned that a separate switch can be provided to activate and deactivate the audible signals. Also, the mechanism could allow the user to adjust the intensity of one or more of the visual warning signals. Additionally, it is envisioned that the mechanism could allow the user to adjust the repetition of one or more of the warning signals.

In the preferred embodiment of the invention, the precreated verbal warning messages would be prepared at the device assembly location or other locations prior to the end user obtaining the device. It is envisioned that the user would purchase the device and, barring modifications to the device, basically be limited to the messages that were provided with the device at the time it was delivered to the user. Alternatively, the warning system can be configured to permit a user to create at least one of the plurality of precreated verbal warning messages. For example, the warning system could comprise an analogue signal port or digital signal port or an infrared signal port or a combination thereof which would allow the user to "download" a new message. As a further example, the safety device 10 could permit memory chips to be removed and replaced to allow new messages to be added. These messages could be created on a mechanism that is separate from the safety device, such as a computer or a dictaphone. These new messages could also be obtained from the safety device manufacturer or other compatible sources. These messages could also be created by attaching a microphone to the warning system, wherein the warning system would contain a recording mechanism. Further, the warning system could comprise a self contained recording system 36, including a microphone 38 allowing the user to create a new message by speaking at the device. It is envisioned that recording system 36 can be part of control system 24, or can be separate from control system 24. The structure needed to implement these concepts will be apparent to one skilled in the art upon consideration of the present disclosure.

It is envisioned that the precreated audible warning signals can be stored in a variety of forms. For example, the warning signals can be stored in an analogue format or a digital format. It is further envisioned that the audible warning signals can be synthesized by the warning system, although the invention is not limited to synthesized signals.

Figure 4:
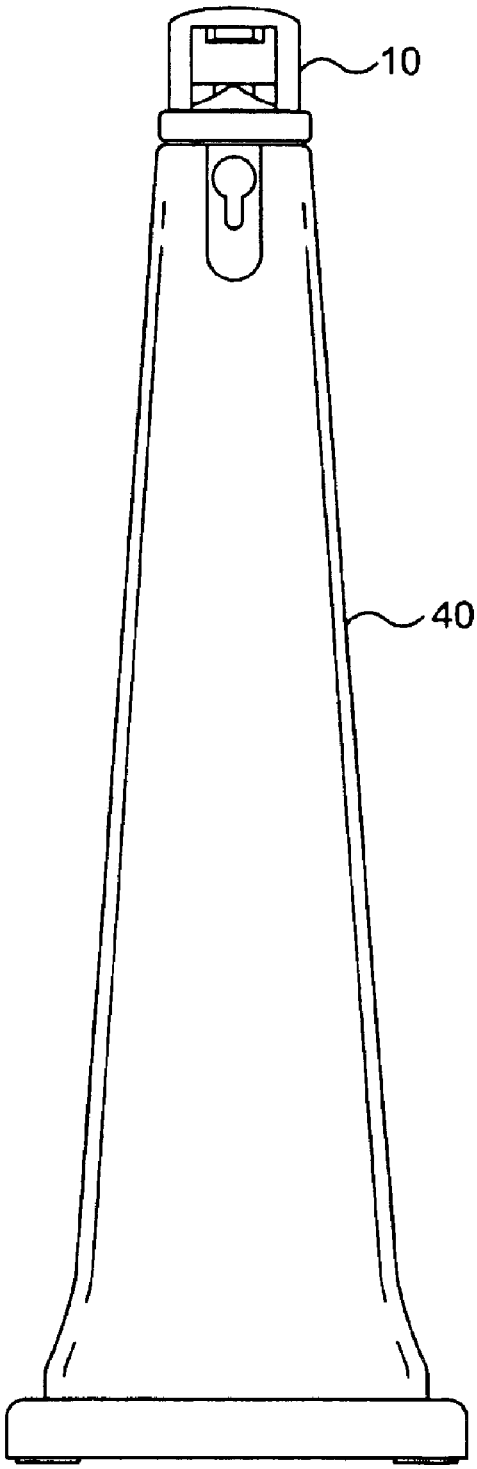
FIG. 4 is a side view of the safety device of FIG. 1 including a safety cone.
Figure 10:
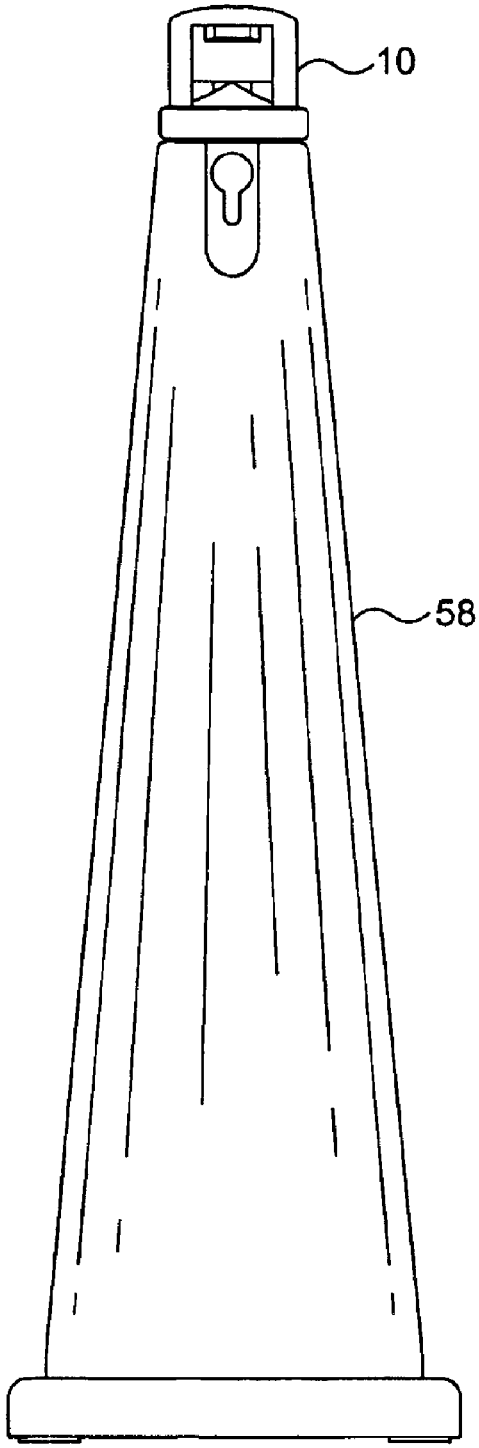
FIG. 10 is a side view of the safety device of FIG. 1 including a safety cone with a circular cross section.

Additionally, the safety device 10 preferably includes a support structure. For example, FIG. 4 shows a safety cone 40 as the support structure. The safety cone 40 shown in FIG. 4 has four canted sides, although it is envisioned that safety cones having more than four canted sides and safety cones having less than four canted sides will be used to practice the present invention. It is envisioned that safety cones without canted sides will be used. Indeed, safety cones having substantially circular cross sections and substantially elliptical cross sections can be used as well. FIG. 10 shows a safety cone 58 with a circular cross section.

In a preferred embodiment of the present invention, the warning system is located at the top of the safety device, although it is envisioned that other embodiments of the present invention will have the warning system located below the top of the safety device. Locating the warning system at the top of the device will provide for greater noticeability of the warning signal.

It is further envisioned that warning devices can be designed to be easily attached and removed from a support structure. For example, a safety cone 40 can have a mechanism that permits the safety device 10 to snap fit onto the top of the safety cone 40. Alternatively, the safety device can be provided with the attaching mechanism. Further, it is envisioned that the safety device can be retrofitted to existing warning devices.

Figure 5:
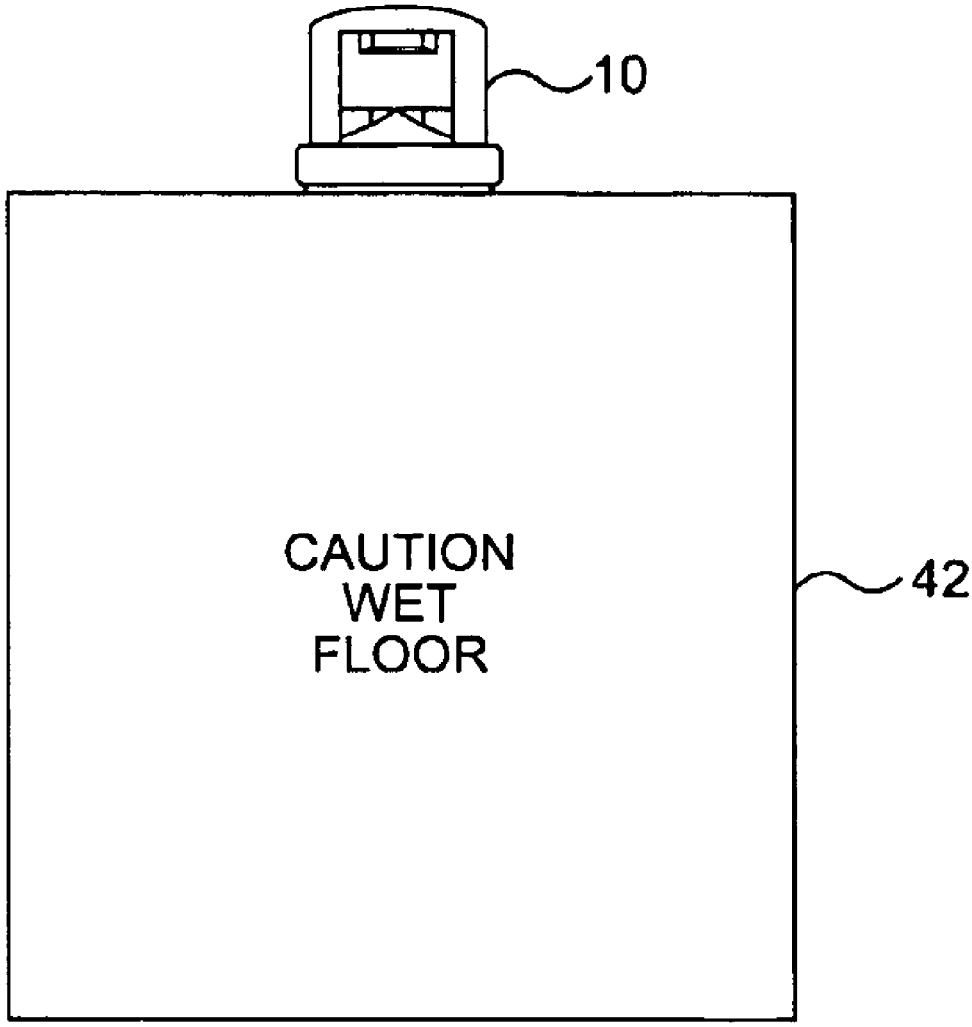
FIG. 5 is a side view of the safety device of FIG. 1 including a sign.
Figure 6:
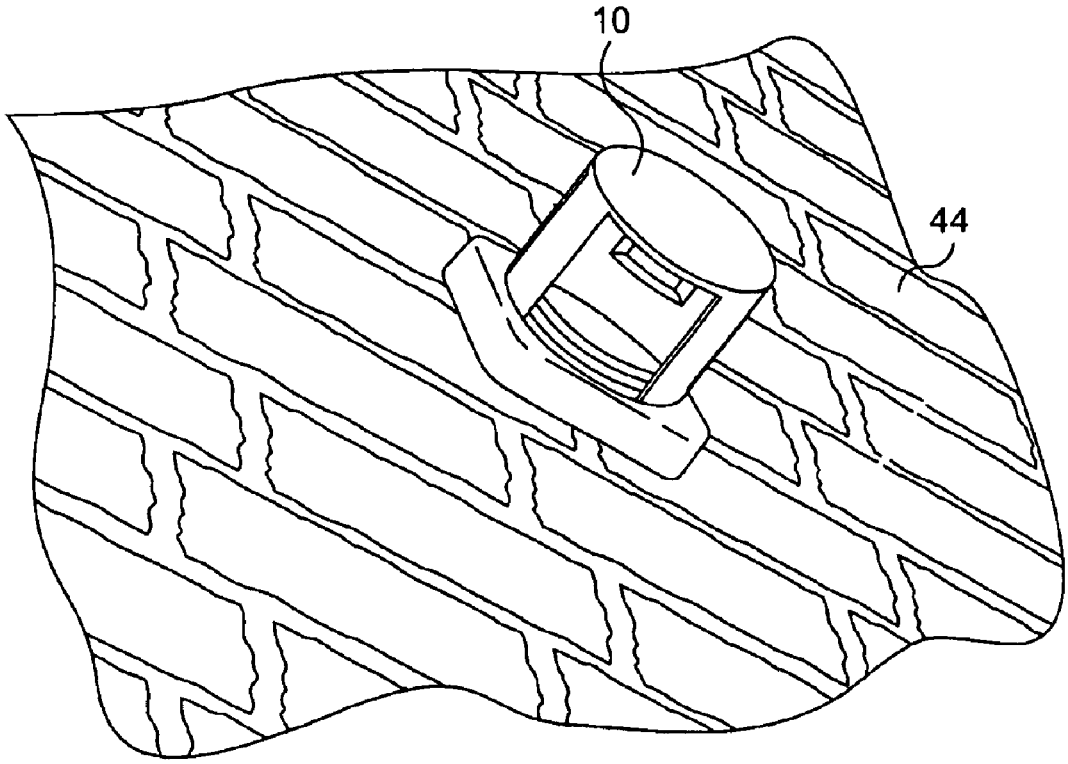
FIG. 6 is a side view of the safety device of FIG. 1 mounted on a permanent structure.

It is envisioned that support structures of other forms can be utilized, such as tripods and sign posts. It is further envisioned that the safety device can be hung from a ceiling or overhang, using, for example, chain, wire cable, straps, rope, etc. One embodiment of the present invention is envisioned where the support structure includes a sign 42, as can be seen in FIG. 5. For example, the sign could be hung on a wall, or it could be on a sign post. As shown in FIG. 6, the safety device can also be configured to be attached to a permanent structure 44. It is envisioned that the safety device can be both permanently attached to the permanent structure, or can be removed and installed to the permanent structure. Indeed, it is envisioned that the safety device could be an integral part of the permanent structure.

As can be seen from the above examples, it is envisioned that some embodiments of the present invention will be portable, while other embodiments will not be portable. Further, as seen from the above examples, a number of control devices may be provided with some of the embodiments of the present invention. It is envisioned that some or all of the control devices are hidden from plain view. For example, control devices can be hidden inside the safety device or on the bottom of the safety device. The above described safety device 10 allows a user to provide a warning by disposing the safety device in a displacement area. The safety device 10 emits at least one warning signal after the sensor senses an object.

As mentioned above, the safety device 10 can include a plurality of warning signals. Those warning signals could correspond to a variety of potential displacement areas for the safety device 10. For example, the safety device 10 could include a verbal "warning, wet floor" warning signal that is to be used when the safety device 10 is disposed in a hallway having a wet floor, a verbal "warning, restroom being serviced" warning signal that is to be used when the safety device 10 is disposed in front of a restroom, and a flashing red light to be used when the safety device 10 is disposed near a high pedestrian traffic intersection. The user can select the appropriate warning signal for a particular displacement area either before or after the safety device 10 is disposed in that area. For example, if the safety device 10 is to be deployed near a wet floor, the user would select the "warning, wet floor" warning signal. After deployment, the safety device would emit the selected signal after an object is sensed.

As a further example, the user could select two of the precreated warning signals to be emitted from the safety device. This might include the message "warning, wet floor," preceded or proceeded by a horn, or preceded or proceeded by a flashing light, or any combination thereof.

As can be seen from the above descriptions of the preferred embodiments, the present invention overcomes shortcomings of previous warning devices in that the warning device of the present invention is much more noticeable. For example, the limitation to line of sight visual contact of previous devices and the ease with which modern pedestrians can overlook or even ignore such devices can be overcome by the invention. The present invention can also improve upon the life expectancy and service times required for devices of the present invention as compared to previous warning devices. Additionally, the disclosed invention also can provide the user with the ability to adapt the warnings to the desired situation, another improvement over prior warning devices.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A safety device, comprising:

a safety cone;

at least one sensor for sensing the presence of an object within proximity of the safety cone, the object being a distance from the safety cone; and a warning system configured to emit at least one precreated verbal warning message after the sensor senses an object, wherein the warning system includes a control system configured to enable a user to select at least one of a plurality of precreated verbal warning messages to be emitted in response to the sensor sensing the presence of an object, wherein the-safety device further comprises a support structure, wherein the support structure includes a sign.

2. The safety device of claim 1, wherein the safety cone is portable.

3. The safety device of claim 1, wherein the at least one sensor is configured to detect the presence of a human.

4. The safety device of claim 1, wherein the sensor is passive.

5. The safety device of claim 1, wherein the at least one sensor comprises a plurality of sensing devices.

6. The safety device of claim 5, wherein the sensing devices are equally spaced apart from each other.

7. The safety device of claim 5, wherein at least one of the sensing devices differs from at least one other sensing device.

8. The safety device of claim 1, wherein the warning system is configured to enable a user to adjust a sensing range of the sensor.

9. The safety device of claim 1, wherein the at least one sensor is located at the top of the safety device.

10. The safety device of claim 1, wherein the warning system is configured to enable a user to create at least one of the plurality of precreated verbal warning messages.

11. The safety device of claim 10, wherein the warning system further includes a microphone for a user to record a warning message to create the at least one of the plurality of precreated verbal warning messages.

12. The safety device of claim 1, wherein the messages are synthesized.

13. The safety device of claim 1, wherein the warning system is further configured to emit at least one visual warning signal after the sensor senses an object.

14. The safety device of claim 13, wherein the control system is configured to enable a user to select the at least one visual warning signal.

15. The safety device of claim 1, wherein the volume of the emitted precreated verbal warning message is adjustable.

16. A safety device, comprising:

a safety cone;

at least one sensor for sensing the presence of an object within proximity of the safety cone, the object being a distance from the safety cone; and a warning system configured to emit at least one precreated verbal warning message after the sensor senses an object, wherein the warning system includes a control system configured to enable a user to select at least one of a plurality of precreated verbal warning messages to be emitted in response to the sensor sensing the presence of an object; wherein the sensor is active.

17. A safety device, comprising:

a safety cone;

at least one sensor for sensing the presence of an object within proximity of the safety cone, the object being a distance from the safety cone; and a warning system configured to emit at least one precreated verbal warning message after the sensor senses an object, wherein the warning system includes a control system configured to enable a user to select at least one of a plurality of precreated verbal warning messages to be emitted in response to the sensor sensing the presence of an object; wherein the warning system is further configured to emit at least one precreated non-verbal audible warning after the sensor senses an object.

18. A safety device, comprising:

a safety cone;

at least one sensor for sensing the presence of an object within proximity of the safety cone, the object being a distance from the safety cone; and a warning system configured to emit at least one precreated verbal warning message after the sensor senses an object, wherein the warning system includes a control system configured to enable a user to select at least one of a plurality of precreated verbal warning messages to be emitted in response to the sensor sensing the presence of an object, wherein the safety device further comprises user controls which are disposed so as to be hidden from view while the sensor is operational.

19. A safety device, comprising:

a safety cone;

a sensor disposed on the safety cone and configured to sense a human at a distance from the safety cone;

a warning system disposed at the top of the safety cone and configured to emit at least one of a plurality of precreated warning signals in response to the sensor sensing a human; wherein the sensor is active.

20. The safety device of claim 19, wherein the safety cone comprises at least three canted sides.

21. The safety device of claim 19, wherein the safety cone has a substantially circular cross section.

22. The safety device of claim 19, further including a passive sensor.

23. The safety device of claim 19, wherein the warning system is configured to enable a user to adjust a sensing range of the sensor.

24. The safety device of claim 19, wherein the warning signal includes at least one precreated verbal warning message.

25. The safety device of claim 24, wherein the volume of the emitted precreated verbal warning message is adjustable.

26. The safety device of claim 19, wherein the warning system is configured to emit at least one visual warning signal in response to the sensor sensing an object.

27. The safety device of claim 26, wherein the warning system is configured to enable a user to select the visual warning signal.

28. A safety device, comprising:

a safety cone;

a sensor disposed on the safety cone and configured to sense a human at a distance from the safety cone;

a warning system disposed at the top of the safety cone and configured to emit at least one of a plurality of precreated warning signals in response to the sensor sensing a human; wherein the sensor comprises a plurality of sensing devices.

29. The safety device of claim 28, wherein the sensing devices are equally spaced apart from each other.

30. The safety device of claim 28, wherein at least one of the sensing devices differs from at least one other sensing device.

31. A safety device, comprising:

a safety cone;

a sensor disposed on the safety cone and configured to sense a human at a distance from the safety cone;

a warning system disposed at the top of the safety cone and configured to emit at least one of a plurality of precreated warning signals in response to the sensor sensing a human; wherein the warning signals include at least one precreated nonverbal audible warning.

32. A safety device, comprising:

a safety cone;

an active sensor disposed on the safety cone configured to sense an object at a distance from the safety cone;

a warning system disposed at the top of the safety cone and configured to emit at least one warning signal in response to the sensor sensing an object, the warning system including a control system that allows a user to select at least one of a plurality of warning signals to be emitted.

33. A safety device, comprising:

a safety cone;

an active sensor disposed on the safety cone configured to sense an object at a distance from the safety cone;

a warning system disposed at the top of the safety cone and configured to emit at least one warning signal in response to the sensor sensing an object;

wherein the warning system is configured to permit a user to create the at least one warning signal.

34. The safety device of claim 33, wherein the warning system further includes a microphone that enables a user to record a warning message to create the at least one warning signal.

35. A safety device, comprising:

a safety cone;

a sensor disposed on the safety cone and configured to sense a human at a distance from the safety cone;

a warning system disposed at the top of the safety cone and configured to emit at least one of a plurality of precreated warning signals in response to the sensor sensing a human; wherein the safety device further comprises user controls which are disposed so as to be hidden from view while the sensor is operational.

36. A method of providing a warning, including the steps of:

providing a self-contained safety device containing a plurality of precreated verbal warning signals associated with a plurality of displacement areas, which safety device emits at least one of the precreated verbal warning signals after an object is sensed, wherein the self contained safety device includes a sign;

disposing the safety device in a displacement area;

selecting at least one of the precreated verbal warning signals for emission based on the displacement area.

37. The method of providing a warning of claim 36, wherein the object to be sensed includes a human.

38. The method of providing a warning of claim 36, wherein the plurality of precreated warning signals includes at least one nonverbal audible warning message.

39. The method of providing a warning of claim 36, wherein the plurality of precreated warning signals includes at least one visual warning.

40. The method of providing a warning of claim 36, wherein the selecting step occurs before the disposing step.

41. A safety module comprising:

a housing adapted to be detachably attached to a support structure;

at least one active sensor affixed to the housing configured to sense the presence of an object within proximity of the support structure, the object being a distance from the support structure; and a warning system affixed to the housing to emit one or more of a plurality of warning signals, including at least one verbal warning message, in response to the sensor sensing the presence of the object, the warning system including a control system adapted to enable a user to select a particular verbal warning message to be emitted in response to the sensor sensing the presence of the object.

42. The safety module of claim 41, wherein the housing is configured to hang from the support structure.

43. The safety module of claim 41, wherein the warning system is configured to store one or more customized verbal warning messages recorded by a user.

44. The safety module of claim 41, wherein the warning signals further include a visual signal.

45. The safety module of claim 44, wherein the visual signal comprises a flashing light.

46. A safety module comprising:

a housing adapted to be detachably attached to a support structure;

at least one sensor affixed to the housing configured to sense the presence of an object within proximity of the support structure, the object being a distance from the support structure;

a warning system affixed to the housing to emit one or more of a plurality of warning signals, including at least one verbal warning message, in response to the sensor sensing the presence of the object, the warning system including a control system adapted to enable a user to select a particular verbal warning message to be emitted in response to the sensor sensing the presence of the object; wherein the housing is configured to be attached to the top of a safety cone.

47. The safety module of claim 46, wherein the control system includes means for a user to select which of the warning signals are to be emitted in response to the sensor sensing the presence of the object.

48. The safety module of claim 47, wherein the means for a user to select includes a manually actuated member disposed on a surface of the housing.

49. The safety module of claim 48, wherein the surface on which the manually actuated member is disposed is hidden from view while the housing is attached to a support structure.

50. The safety module of claim 49, wherein the support structure is a safety cone.

51. A method of providing a warning comprising:

providing a module comprised of: a housing adapted to be detached from a support structure; at least one active sensor affixed to the housing, which is configured to sense the presence of an object within proximity of a support structure, the object being a distance from the support structure; and a warning system affixed to the housing to emit one or more of a plurality of warning signals, including at least one verbal warming message, in response to the sensor sensing the presence of the object, wherein the warning system includes a control system adapted to enable a user to select a particular verbal warning message to be emitted in response to the sensor sensing the presence of the object; and affixing the module to the support structure.

52. The method of claim 51, wherein affixing comprises hanging the module from the support structure.

53. The method of claim 51, wherein the warning system is configured to store one or more customized verbal warning messages recorded by a user.

54. The method of claim 51, wherein the warning signals further include a visual signal.

55. The method of claim 54, wherein the visual signal comprises a flashing light.

56. The method of claim 51, further comprising providing at least one selection member on the module by which a user may select which warning signals are to be emitted in response to the sensor sensing the presence of the object.

57. The method of claim 56, wherein the selection member is manually actuated.

58. The method of claim 57, wherein the selection member is provided on a surface of the module that is hidden from view after the module is affixed to the support structure.

59. The method of claim 58, wherein the support structure is a safety cone.

60. A method of providing a warning comprising:

providing a module comprised of: a detachable housing adapted to be detached from the module; at least one sensor affixed to the housing, which is configured to sense the presence of an object within proximity of a support structure, the object being a distance from the support structure; and a warning system affixed to the housing to emit one or more of a plurality of warning signals, including at least one verbal warning message, in response to the sensor sensing the presence of the object, wherein the warning system includes a control system adapted to enable a user to select a particular verbal warning message to be emitted in response to the sensor sensing the presence of the object; and affixing the module to a support structure; wherein the support structure is a safety cone.

61. The method of claim 60, wherein affixing comprises attaching the module to the top of the safety cone.

* * * * *